United States Patent [19]

Bühler

[11] 4,435,814

[45] Mar. 6, 1984

[54] ELECTRIC FURNACE HAVING LIQUID COOLED VESSEL WALLS

[75] Inventor: Karl Bühler, Nussbaumen, Switzerland

[73] Assignee: BBC Brown, Boveri & Company, Limited, Baden, Switzerland

[21] Appl. No.: 460,302

[22] Filed: Jan. 24, 1983

[30] Foreign Application Priority Data

Jan. 29, 1982 [CH] Switzerland ..... 552/82

[51] Int. Cl.[3] ..... F27D 1/12

[52] U.S. Cl. ..... 373/76

[58] Field of Search ..... 373/73–76; 266/280, 286; 432/248, 250; 110/331, 332, 335, 336

[56] References Cited

U.S. PATENT DOCUMENTS

| | | | |
|---|---|---|---|
| 3,829,595 | 8/1974 | Nanjyo et al. | 373/76 |
| 4,206,312 | 6/1980 | Kuhlmann | 373/76 |
| 4,335,870 | 6/1982 | Diener | 373/76 |

*Primary Examiner*—Roy N. Envall, Jr.

*Attorney, Agent, or Firm*—Oblon, Fisher, Spivak, McClelland & Maier

[57] ABSTRACT

An electric furnace including a furnace vessel having modular thermally stressed wall parts, wherein in order to lengthen the service life of the thermally stressed wall parts of furnace, cooling pipes formed in inner and outer layers are provided with the cooling pipes of the inner layer located in a fireproof construction material. These cooling pipes form the reinforcement for the fireproof construction material.

The inner layer of cooling pipes face the inside of the vessel and are made in one piece, U-shaped at the upper and the lower ends thereof and lead into the outer layer of cooling pipes. The outer layer of cooling pipes empty into a liquid distributing conduit provided with at least one integrated bypass opening whereby cooling liquid is at least partially short-circuited between pipes in the outer layer.

The cooling pipe is thermally stressed and relieved in a homogeneous manner by the one-piece construction of the cooling pipes facing the inside of the vessel, by U-shaped transitions to the outer cooling pipe and by the avoidance of welding seams and other material connections in the cooling pipe, so that thermal stresses in the cooling system are almost excluded and the cooling system is largely freed from the effects of alternating temperature stresses.

9 Claims, 6 Drawing Figures

ELECTRIC FURNACE HAVING LIQUID COOLED VESSEL WALLS

BACKGROUND OF THE INVENTION

1. Field of the Invention

This invention relates to an electric furnace, particularly an electric arc furnace, provided with a liquid cooling device for cooling thermally highly stressed wall parts of the furnace vessel, including essentially vertical cooling pipes which are series-connected in groups and through which liquid flows, wherein a bypass opening which short-circuits the cooling conduits at least partially is provided in the upper part of the vessel between adjacent cooling conduits.

2. Description of the Prior Art

Such a furnace is disclosed in Swiss patent application 3280/81-4 of 5-20-1981, which particularly teaches simple solutions for removing from the cooling system gas bubbles which are produced by local overheating and can adversely affect the cooling action or even result in the destruction of the cooling device, by positioning bypass openings in the upper part of the series-connected, vertical cooling pipes.

The publication of Korf-Fuchs Systemtechnik; "Stahlerzeugung Wasserkühlsysteme für Lichtbogenöfen", translated, "Steel Production Water Cooling Systems for Arc Furnaces", undated, teaches cooling boxes which can be built in individually or as complete cooling systems for forming vessel walls in an arc furnace boiler. Constructive measures are intended to prevent cooling water from entering into the furnace area if the cooling boxes are perforated. A protective coating of fireproof material which is relatively thin compared to the thickness of a traditional, uncooled vessel wall of fireproof material of an arc furnace is applied to the cooling box walls which face the inside of the furnace. This protective coating protects the cooling boxes against heat radiation and prevents too much heat from being removed from the smelting area. The protective coating is additionally reinforced during smelting by spatters of slag which are cast against the walls by the action of the arc, where they remain clinging. Camlike projections attached to the walls of the cooling boxes reinforce the adhesion of the fireproof material and of the slag spatters.

A similar water cooling of the vessel walls of arc furnaces is known from the publication of the Lectromelt Corporation; "Water-Cooled Panels", April, 1980.

Fireproof material can be saved if cooling boxes are used to cool the vessel walls of arc furnaces, but there is also the danger, given the relatively thin protective coatings on the walls of the cooling boxes, that they can loosen at certain spots in an uncontrolled fashion, e.g. by mechanical action during the charging process, by the action of iron or slag spatters during the smelting process or by thermal tensions inside the coatings as a result of inhomogeneous heat radiation, unequal cooling action or when the vessel walls cool down. The heat transfer and thus the heat loss is particularly great at the exposed areas where the metal surface of the cooling box is directly irradiated by arcs.

Moreover, the non-protected areas receive a greater thermal stress than the other, protected cooling box wall and hot spots can develop by the smelting in two-shift or three-shift operation which is normally continuous in steel plants and foundries without being noticed by the operating personnel. In the most unfavorable instances, if they remain uncovered and the cooling conditions are unsatisfactory, these spots can become overheated to the extent that they result in perforations and severe associated consequences. Detection systems for monitoring cooling systems are complicated and expensive. If there were an indication of trouble, the furnace would then have to be taken out of operation so that the defective spots could be repaired.

In addition, the cooling walls of the cooling boxes which face the inside of the furnace, even though they are covered with a protective coating and were given a stress-free annealing before assembly, are constantly exposed to forces of expansion and contraction due to sharp variations of temperature. These forces particularly affect the corners and edges of the cooling surfaces, and thermal stresses arise in the welding seams connecting the cooling surfaces, in which tears can form under certain conditions which result in a breakthrough of water.

SUMMARY OF THE INVENTION

Accordingly, the objects of this invention are to provide a novel electric furnace, especially an electric arc furnace, having a cooling system which is simple to construct and economical to finish, with which a long useful life of the vessel walls can be achieved and the construction of which practically eliminates instances of damage.

These and other objects are achieved according to the invention by providing an electric furnace including a cooling system formed by cooling pipes constructed in inner and outer layers, wherein the inner layer of cooling pipes facing the inside of the furnace are made in a single piece and are U-shaped at the upper and the lower ends thereof, to which ends the cooling pipes of the outer layer are connected, and empty into a liquid distributing chamber with integrated bypass openings, whereby at least the cooling pipes of the inner layer facing the inside of the furnace are embedded in a fireproof construction material which reinforces the cooling pipes of the inner layer.

This embodiment has the following advantages:

Due to the single-piece construction and the rounded ends of the cooling pipes, the heat is taken up and given off evenly by the cooling pipes. Since edges and corners as well as material connections are avoided in the part of the cooling pipes facing the inside of the furnace, no thermal stresses can develop in this part and the cooling system is largely removed from the effects of alternating temperature stresses.

Cooling a qualitatively high-grade fireproof construction material reduces its wear and tear, resulting in a long service life of the vessel walls.

The bypass openings integrated into the liquid distributing chamber makes it possible for the cooling liquid heated in the cooling pipes which are series-connected in groups to mix with cold cooling liquid, which avoids overheating.

Further according to the invention, the spacing of the oppositely adjacent cooling pipes of the inner layer is approximately twice as great as their outer diameter. This keeps the weight of the composite construction of cooling pipes and fireproof construction material low while assuring an optimum cooling of the fireproof construction material and sufficient strength of the carrying construction for the fireproof construction material.

The cooling pipes together with the fireproof construction material can be set into the furnace vessel as prefabricated, segmentlike wall element. This makes it economical to insert and remove the segmentlike wall elements, and the down time of the furnaces can be limited to a minimum. Each wall element has its own cooling circulatory system. This has the advantage that the cooling can be made distinct and intensive for each wall element.

Further according to the invention, the bypass opening(s) in the distributing conduit are dimensioned so that, taking into consideration the hydraulic resistance of the associated cooling conduits, a predeterminable amount of cooling liquid flows through the bypass opening(s), which is smaller than the amount which flows through the associated cooling conduits.

Alternatively the bypass opening(s) in the distributing conduit are dimensioned so that, taking into consideration the hydraulic resistance of the associated cooling conduits, a predeterminable amount of cooling liquid flows through the bypass opening(s), which is just as great or greater than the amount which flows through the associated cooling conduits. Accordingly, the invention has the advantage of the fact that the rate of flow, flow speed, etc. of the cooling liquid which is introduced into the cooling conduits and the cooling conduits themselves can be dimensioned so that if part of the cooling liquid vaporizes in the cooling conduits, the vapor is immediately removed from the associated bypass opening(s) of every associated cooling conduit pair in the cooling liquid distributing chamber without the occurrence of an interaction between the cooling liquid and the vapor, which would be disadvantageous for the cooling action. A combined liquid-vapor cooling is obtained in this manner, in contrast to the classic liquid cooling, whereby the heat required for vaporization is removed from the construction parts to be cooled and is thus made useful for cooling. The flow speed of the cooling liquid in the cooling pipes is measured so that no vapor bubbles can settle in the upper pipe turns of the cooling pipes, but rather they are carried away with the cooling liquid and transported into the distributing conduit.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
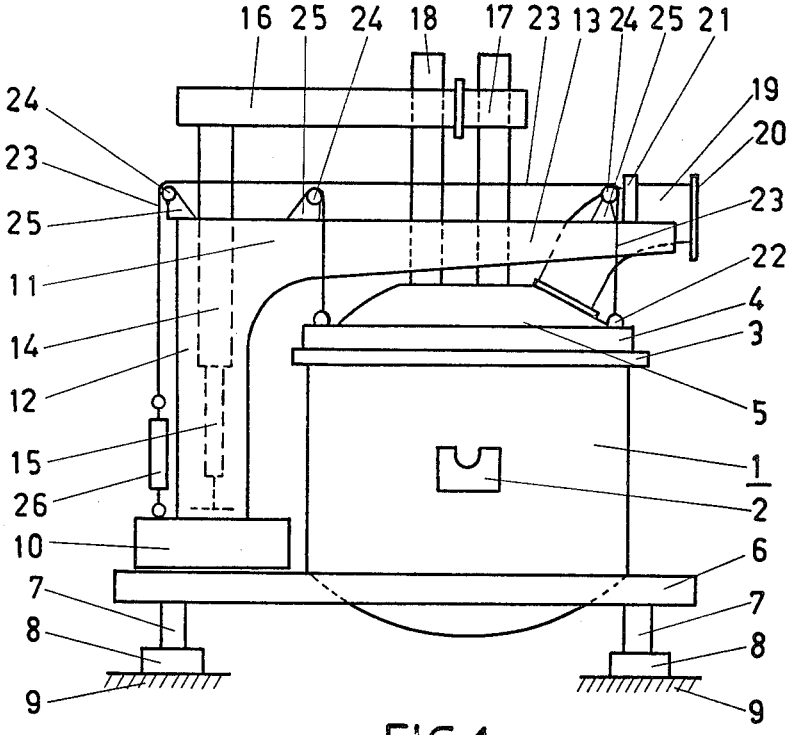
FIG. 1 is a schematic front view of an embodiment of an arc furnace according to the invention.

Referring now to the drawings, wherein like reference numerals designate identical or corresponding parts throughout the several views, and more particularly to FIG. 1 thereof, there is shown an arc furnace boiler 1 having a furnace cover 5 carried in an opening on platform 6, which is supported on two hob cradles 7 supported on cradle beams 8 which are permanently anchored to foundation 9. FIG. 1 also shows pouring lip 2. Movable rotary pad 10 is located on platform 6, to which pad the cover raising and pivoting device 11 is fastened. Cover raising and pivoting device 11 consists of carrier arm 13 and carrier arm column 12.

Platform 6 also carries three electrode positioning columns 14, only one of which is visible in FIG. 1. Electrode positioning columns 14 are vertically connected to electrode positioning cylinders 15 so that they can be moved individually hydraulically. Electrode carrier arms 16 are fastened to electrode positioning columns 14, and electrodes 18 are held in electrode holders 17 on their outer ends.

Only one of the three electrode carrier arms 16 is completely visible, and only two of electrodes 18 can be seen, as the third is covered. Boiler gas removal piece 19 with flange 20 is located on furnace cover 5, cover ring 4 of which rests on cover carrier ring 3 of furnace boiler 1. The fastening of piece 19 is not shown in FIG. 1, and its guiding arrangement inside carrier arm 13 of cover raising and pivoting device 11 is not only indicated by guide tracks 21. Carrying lugs 22 are located on cover ring 4 of furnace cover 5, in which carrying cables 23 are fastened in the embodiment of FIG. 1, only two of which from a total of four are visible. Carrying cables 23 run over rollers 24 which are carried in roller carriers 25 on carrier arm 13. Carrying cables 23 are connected to hydraulic cylinder 26, which can raise and lower furnace cover 5 from and onto furnace boiler 1.

Figure 2:
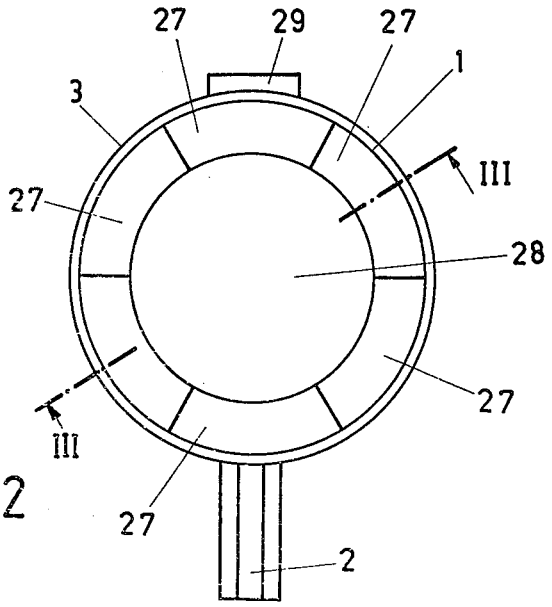
FIG. 2 is a schematic top view of the furnace of FIG. 1, but with the furnace cover removed.

FIG. 2 shows a top view of the furnace of FIG. 1, but with furnace cover 5 removed. Prefabricated wall elements 27, which are located inside vessel jacket 1, are visible. There are six wall elements 27 in the embodiment of FIG. 2. However, this number can vary and depends on the size of the furnace. It is advantageous if the number of wall elements 27 increases as the furnace becomes larger. Vessel bottom 28 can be seen inside the furnace vessel, and slag door 29 is visible opposite pouring lip 2.

Figure 3:
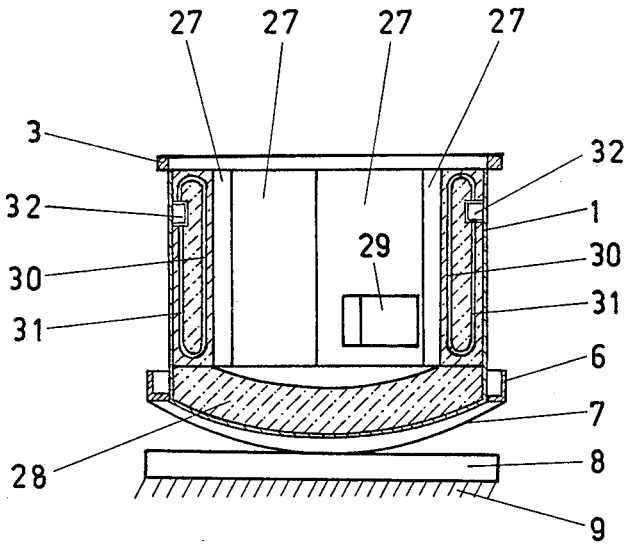
FIG. 3 is a cross-sectional side view of the furnace of FIG. 2.

FIG. 3 shows a section through the side view of the furnace according to FIG. 2. Cooling system 30, 31, 32 can be recognized in sectioned wall elements 27 and consists of cooling pipe layer 30 facing the inside of the vessel, outer cooling pipe layer 31 and cooling liquid distributing conduit 32. For reasons of clarity, the connection lines outside of vessel jacket 1 required for cooling system 30, 31, 32 are not shown in FIG. 3.

Figure 4:
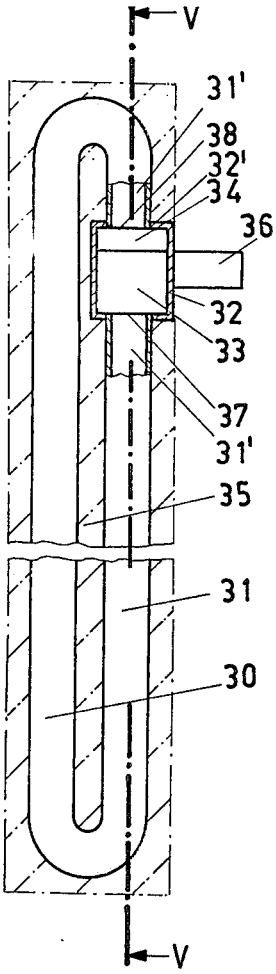
FIG. 4 is an enlarged, view partially in cross-section of a cooling pipe arrangement with fireproof construction material according to FIG. 3.

FIG. 4 shows an enlarged partial vertical section through a cooling pipe arrangement 30, 31, 32 with fireproof construction material according to FIG. 3.

FIG. 4 also shows cooling pipe layer 30, which faces the inside of the vessel, with upper and lower U-shaped turns, to the ends of which outer cooling pipe layer 31 connects in a one-piece fashion. The ends of cooling conduits 31' of outer cooling pipe layer 31 empty via cooling conduit entrance opening 37 and via conduit exit opening 38 into cooling liquid distributing conduit 32. Reference numeral 36 designates a fastening plate for fastening the wall element consisting of cooling system 30, 31, 32 and fireproof construction material 35 in furnace vessel jacket 1.

Figure 5:
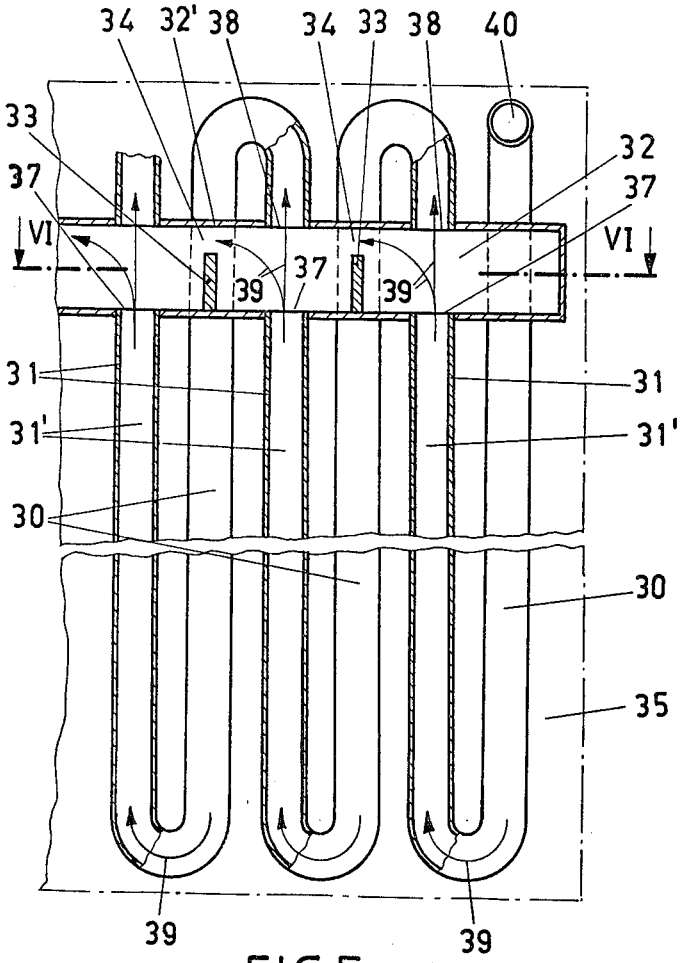
FIG. 5 is a vertical cross-sectional view of a cooling arrangement with fireproof construction material according to FIG. 4.

FIGS. 4 and 5 both show dividing walls 33 between which and the upper end plate 32' of liquid distributing conduit 32 the bypass opening(s) is (are) located.

In FIG. 5 reference numeral 40 designates the cooling liquid entrance opening, and arrows 39 indicate the direction of flow of the cooling liquid. In the embodiment of FIG. 5 the cooling liquid first flows down through the outer right cooling pipe 30, which is associated with the inside of the vessel, is deflected by the lower turn and finally flows up through conduit 31' of the outer cooling pipe 31 and enters through cooling liquid entrance opening 37 into cooling liquid distributing conduit 32. The current of cooling liquid is divided in distributing conduit 32 into two partial currents according to arrows 39. One partial current leaves distributing conduit 32 again through cooling liquid exit opening 38, flows up at first in the direction of the arrow, is deflected by the upper turn, flows down through cooling pipe 30, is deflected by the lower turn and flows up again through cooling conduit 31' of cooling pipe 31 and enters through cooling liquid entrance opening 37 into distributing conduit 32. Since cooling pipe 30 is associated with the inside of the vessel, the cooling liquid of the first partial current was heated and comes together in distributing conduit 32 with the second part of the cooling current, which was deflected horizontally and flowed through bypass opening 34, in the area between the two dividing walls 33 shown in FIG. 5. As the second part of the current of cooling liquid has a comparatively lower temperature than the first one, which flowed through cooling pipe 30, the first part of the current of cooling liquid is cooled by the second part. This process of cooling the part of the cooling liquid which was heated during its passage through cooling pipes 30 facing the inside of the vessel by the part of the cooling liquid which remained in distributing conduit 32 and passed through the bypass opening(s) is constantly repeated in cooling pipes 30 of each wall element 27 of the furnace vessel, which pipes are connected in series and in groups.

If any vapor bubbles were to form in cooling pipe 30, they would collect in the upper pipe turn and adversely effect or interrupt the cooling circulatory system. In order to prevent this, the flow speed of the cooling liquid is selected so that any vapor bubbles which form in the upper pipe turn are transported by the cooling liquid into the distributing chamber.

FIG. 5 shows only one embodiment of the concept of the invention as an example. One variation of the concept of the invention would be to position the distributing conduit obliquely to the horizontal direction, namely, in the direction of flow of the cooling liquid with a widening angle. In this way vapor bubbles could be removed more rapidly from distributing conduit 32. The upper and lower pipe turns of cooling pipes 30, 31 are necessary for reasons of a homogeneous heat load and can not be dispensed with.

Figure 6:
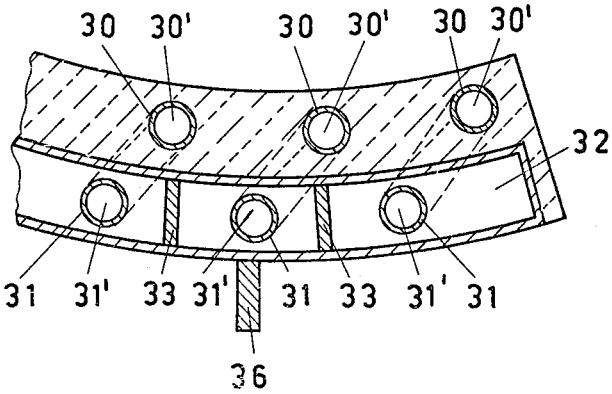
FIG. 6 is a horizontal cross-sectional view of a cooling arrangement with fireproof construction material according to FIG. 5.

FIG. 6 shows a horizontal section through a cooling system 30, 31, 32 with fireproof construction material 35 according to FIG. 5.

FIG. 6 shows the coiled construction and the horizontal lateral staggering of cooling pipes 30, 31 with cooling conduits 30', 31.

The section of FIG. 6 shows only the lower lateral staggering, indicated by the lower pipe turns. The upper lateral staggering is not shown in FIG. 6, but it is in FIG. 5.

FIGS. 4 and 6 give a clear view of the double layers of cooling pipes 30, 31 and also the absence of e.g. welding connections in the thermally heavily stressed cooling pipes 30. Moreover, there are no edges and corners in cooling pipes 30 or at the transitions to cooling pipes 31, in order to ease the heat stress on cooling system 30, 31, 32.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electric furnace comprising:

a furnace vessel having wall parts;

liquid cooling means for cooling said wall parts, comprising, cooling conduits extending substantially vertically in said wall parts, said cooling conduits connected in series in groups and having a cooling liquid flowing therein, said cooling conduits arranged in two layers including an inner layer facing said furnace vessel and an outer layer disposed behind said inner layer relative to said vessel, said conduits of said inner layer having U-shaped upper and lower ends to which the conduits of the outer layer are connected, a distributing chamber communicating with the conduits of said outer layer and including at least one bypass opening for at least partially bypassing cooling fluid from at least one outer layer conduit to another outer layer conduit; and said conduits of said inner layer embedded in and supported by a fireproof construction material.

2. An electric furnace according to claim 1, wherein each cooling conduit of the outer layer of cooling conduits is made in a single piece.

3. An electric furnace according to claim 1, comprising:

said cooling conduits of said inner layer each having a predetermined diameter and spaced apart by a predetermined spacing, wherein said predetermined spacing is approximately twice as great as said outer diameter.

4. An electric furnace according to claim 1, wherein the cooling conduits of said inner and outer layers together with said fireproof construction material are prefabricated in the form of segment-like wall elements each forming a part of the furnace vessel.

5. An electric furnace according to claim 2, wherein the cooling conduits of said inner and outer layers together with said fireproof construction material are prefabricated in the form of segment-like wall elements each forming a part of the furnace vessel.

6. An electric furnace according to claim 3, wherein the cooling conduits of said inner and outer layers together with said fireproof construction material are prefabricated in the form of segment-like wall elements each forming a part of the furnace vessel.

7. An electric furnace according to claim 4, wherein each said wall element includes said liquid distributing chamber and at least one bypass opening.

8. An electric furnace according to claim 1, wherein said at least one bypass opening is sized, taking into consideration the hydraulic resistance of said cooling conduits, such that a predetermined amount of cooling liquid flows through the at least one bypass opening and said predetermined amount of liquid passing through said bypass opening is smaller than the amount of coolant which flows through said cooling conduits.

9. An electric furnace according to claim 1, wherein said at least one bypass opening is sized, taking into consideration the hydraulic resistance of said cooling conduits, such that a predetermined amount of cooling liquid flows through the at least one bypass opening and said predetermined amount of liquid passing through said bypass opening is at least as great as the amount of coolant which flows through said cooling conduits.

* * * * *